United States Patent [19]

Scherrer

[11] 4,050,753

[45] Sept. 27, 1977

[54] BRACEABLE RAIL

[75] Inventor: Kurt Scherrer, Munsingen, Switzerland

[73] Assignee: U. Scharer Sohne AG, (USM), Munsingen, Switzerland

[21] Appl. No.: 719,374

[22] Filed: Sept. 1, 1976

[30] Foreign Application Priority Data

Sept. 5, 1975 Switzerland ..... 11535/75

[51] Int. Cl.[2] ..... E04C 3/30

[52] U.S. Cl. ..... 312/257 SK; 312/214; 52/731

[58] Field of Search ..... 312/257 SK, 214; 52/731

[56] References Cited

U.S. PATENT DOCUMENTS

| | | | |
|---|---|---|---|
| 854,947 | 5/1907 | Hill | 52/731 |
| 1,085,862 | 2/1914 | Herzberg | 52/731 |
| 1,574,563 | 2/1926 | Duff | 52/731 |
| 2,508,032 | 5/1950 | Kennedy | 52/731 |
| 2,831,745 | 4/1958 | Parmet | 312/257 SK |
| 2,843,725 | 7/1958 | Granberg | 52/731 |
| 3,054,486 | 9/1962 | de la Rambelje | 52/731 |
| 3,420,032 | 1/1969 | Felt | 52/731 |

*Primary Examiner*—Paul R. Gilliam
*Assistant Examiner*—Victor N. Sakran
*Attorney, Agent, or Firm*—Zarley, McKee, Thomte, Voorhees & Sease

[57] ABSTRACT

A rail intended to be braced between and connected to two support members, such as parts of furniture, is assembled from two opposingly-nested U-sections having cooperating surfaces designed to press the sections away from each other axially upon assembly, thus bracing the assembled rail between the support members.

2 Claims, 6 Drawing Figures

BRACEABLE RAIL

Figures 1, 2, 3, 4, 5, 6:
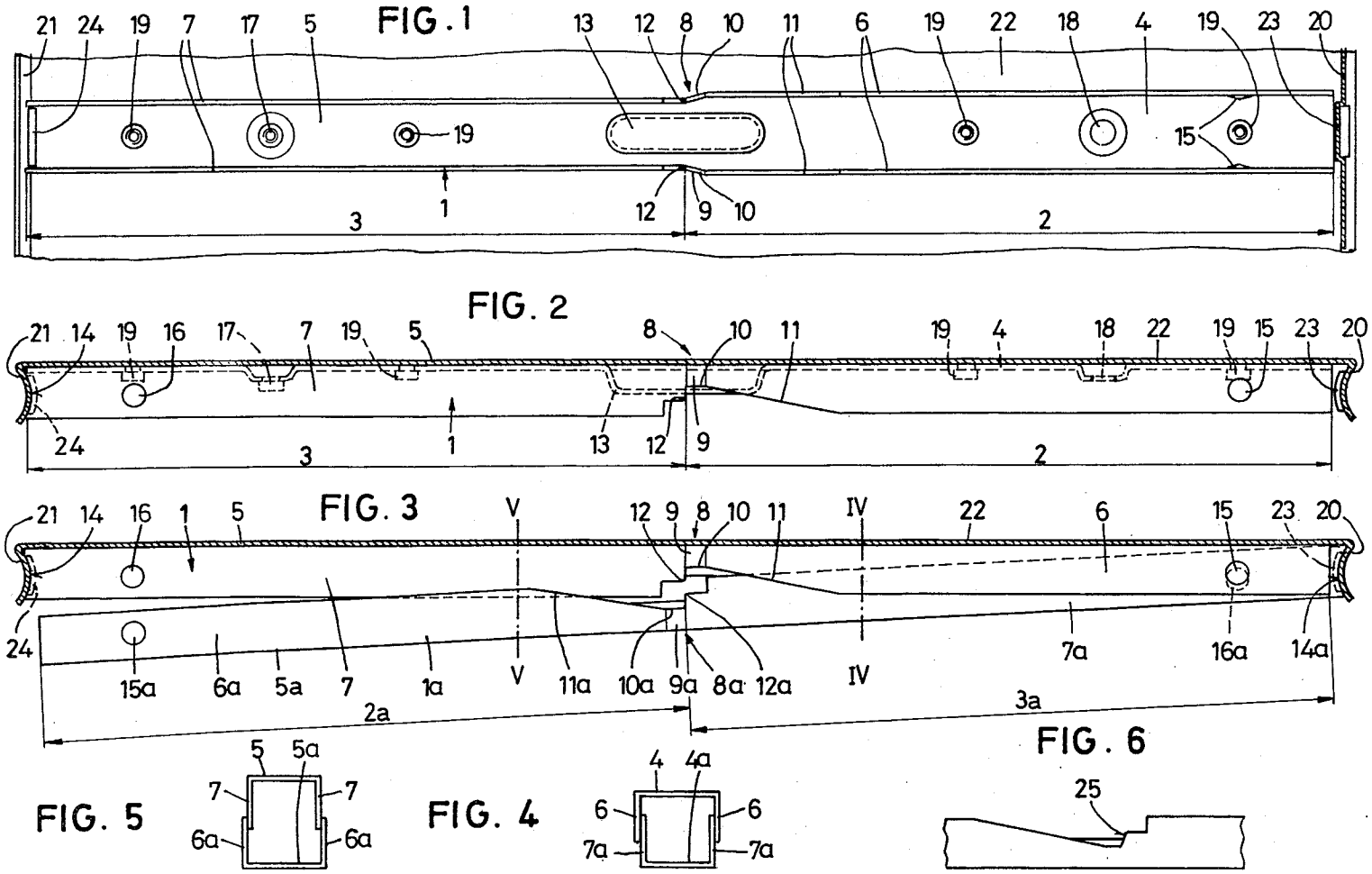

This invention relates to a rail intended to be braced between and form-lockingly connected at each end thereof to two support members.

Rails of this kind are used chiefly in the construction of furniture and, in particular, office furnishings, where they are inserted between two legs serving as supporting members or, for example, between the upwardly bent edges of a sidewall or of a lateral covering plate, and may serve the most varied purposes. One of their most common uses is as sliding rails for adjustable shelves, which are generally secured at the desired height by means of a form-locking connection between the support members and the rail, the connecting members usually being designed so that they can be shifted from an operative position, e.g., against a spring bias, into an inoperative position in which the rail can be detached from the support member.

Connection means designed in this way have the disadvantage of being expensive in their construction, and consequently they cannot be produced cheaply enough. Moreover, because of their mobility, they are inevitably susceptible to a certain amount of trouble.

It is an object of this invention to provide a rail of the type initially described which is very simple in its construction and can be economically produced.

To this end, the rail according to the present invention comprises two substantially U-shaped sectional bars each having two leg portions and being formed of first and second contiguous segments with a region of transition therebetween, the first segments being wider in cross-section than the second segments, the bars being mutually nested with the respective leg portions thereof directed toward each other, whereby the leg portions in the first segment of each bar embrace the leg portions in the second segment of the other bar, each region of transition including a latch surface, and these latch surfaces cooperating to exert an axially-directed force upon the bars for displacing the bars axially in opposite directions.

Two preferred embodiments of the invention will now be described in detail with reference to the accompanying drawing, in which:

FIG. 1 is a top plan view of a sectional bar according to a first embodiment, a wall plate of a piece of office furniture being shown in section, FIG. 2 is a side elevation of the bar shown in FIG. 1, FIG. 3 is a top plan view of two sectional bars intended to be joined to form a rail, shown in the positions they occupy just prior to being joined completely, FIG. 4 is a section taken on the line IV—IV of FIG. 3, but showing the bars completely joined, FIG. 5 is an analogous section taken on the line V—V of FIG. 3, and FIG. 6 is a detail from a side elevation of a sectional bar according to a second embodiment.

FIGS. 1 and 2 show a U-shaped sectional bar 1 comprising two segments 2 and 3 of substantially equal length, the crosspiece 4 of the U-shape in segment 2 being narrower than the corresponding crosspiece 5 in segment 3, whereas the legs 6 of the U-shape in segment 2 are longer than the corresponding legs 7 in segment 3. At a transition point 8 between segments 2 and 3, crosspiece 4 has a constriction 9, whereas legs 7 each exhibit a step-like drop 10, and legs 6 each have an incline 11 sloping toward the lowest point of drop 10. In the embodiment illustrated in FIGS. 1–5, the edge of the lowest step is rounded and thus forms part of a cylindrical generated surface. This rounding 12 forms a latch surface, the significance of which will become apparent further on.

At transition point 8, U-section 1 has an inwardly bent portion 13 to compensate for the cross-sectional weakening caused by drops 10 and inclines 11. The free end of segment 3 takes the form of an inwardly cambered notch 14 for form-locking connection to a correspondingly shaped support member, while the free end of segment 2 is cut off flat. Securing bosses 15 protrude inwardly from legs 6, and matching apertures 16 are provided in legs 7. Furthermore, depending upon the expected load on the rail and the purpose for which it is intended to be used, additional securing members in the form of a securing bolt 17 and a receiving bore 18, and finally means taking the form of screw bushings 19 for securing the rail to any neighboring parts, may be provided.

FIG. 3 illustrates particularly well how a braceable rail is constructed from two identical U-sections 1 and 1*a* and how it is installed, the parts described in connection with U-section 1 being designated by the same reference numerals plus the letter *a* in the case of U-section 1*a*. In the embodiment illustrated, the rail is to be braced between upwardly bent and inwardly cambered edges 20 and 21, serving as support members, of a side plate 22 of, for instance, a piece of office furniture, in which the rail is to serve as a sliding rail for a shelf (not shown). At the respective bracing points, edges 20 and 21 are provided with inwardly projecting support lugs 23 and 24. The manner in which the rail is constructed from U-sections 1 and 1*a* and subsequently braced in place will now be described. First U-section 1 is placed between edges 20 and 21 with legs 6 and 7 pointing downward, as viewed in FIG. 3, in such a way that cambered edge 21 enters notch 14, and support lug 24 enters the hollow profile of U-section 1. The dimensions are such that the flat end of U-section 1 is still slightly spaced from edge 20 (cf. FIG. 1). Next, U-section 1*a*, with legs 6*a* and 7*a* pointing upward, as viewed in FIG. 3, is inserted in exactly the opposite way, i.e., so that notch 14*a* grips under edge 20, and support lug 23 enters the hollow profile of U-section 1*a*. Legs 6 then embrace legs 6*a* in segment 2, while in segment 3, on the contrary, legs 7 enter in between legs 7*a*. If U-section 1*a* is then pressed completely into U-section 1, roundings 12 and 12*a* meet at transition points 8 and 8*a*, and the dimensions are such that the axes of the two cylindrical generated surfaces lie on different sides of the transverse central plane of the rail, viz., each on the same side on which the respective U-section 1 or 1*a* has its notch 14 or 14*a*. As a result of this design of latch surfaces 12 and 12*a*, an axially-directed force is exerted upon U-sections 1 and 1*a*, so that the rail is braced between support members 20 and 21.

FIG. 6 shows a detail of a second embodiment differing from the first embodiment solely in the design of the latch surfaces, which here take the form of inclined surfaces and, like roundings 12 and 12*a*, have the effect of pressing the two U-sections away from each other axially when these surfaces meet during assembly of the U-sections.

When U-sections 1 and 1*a* forming the rail are in the braced position, bosses 15 and 15*a* enter the corresponding apertures 16*a* and 16, respectively, in order to secure the U-sections in their mutual positions. If, depending upon the intended use of rail, this securing means should not suffice, the U-sections may additionally be screwed to each other. Bores 18 and corresponding bolts 17 are provided for this purpose in each U-section. Finally, there might also be a need of attaching the rail to some neighboring parts, for which purpose screw bushings 19 are provided.

As already mentioned, the braceable rail described may be used for the most varied purposes, i.e., for spanning between support members of any kind. It is extremely simple in its construction inasmuch as the U-sections may be produced from two identical blanks by bending up the side portions to form the legs of the U-shaped profile.

What is claimed is:

1. A rail intended to be braced between and form-lockingly connected at each end thereof to two support members, comprising two substantially U-shaped sectional bars each having two leg portions and being formed of first and second contiguous segments with a region of transition therebetween, said first segments being wider in cross-section than said second segments, said bars being mutually nested with the respective leg portions thereof directed toward each other, whereby said leg portions in said first segment of each said bar embrace said leg portions in said second segment of the other said bar, each said region of transition including a latch surface, and said latch surfaces cooperating to exert an axially-directed force upon said bars for displacing said bars axially in opposite directions, wherein each said latch surface is plane and inclined with respect to the longitudinal axis of the respective said bar.

2. The rail of claim 1, wherein each said latch surface forms part of a cylindrical generated surface.

* * * * *